United States Patent [19]

Ruckriegel et al.

[11] 4,109,589

[45] Aug. 29, 1978

[54] END LEAF TABLE

[75] Inventors: Alfred E. Ruckriegel; David W. Buehler, both of Jasper, Ind.

[73] Assignee: Winzeler Stamping Company, Montpelier, Ohio

[21] Appl. No.: 807,945

[22] Filed: Jul. 7, 1977

[51] Int. Cl.[2] ..... A47B 1/04

[52] U.S. Cl. ..... 108/63; 108/69; 108/77

[58] Field of Search ..... 108/69, 77, 78, 63, 108/62, 112, 65, 67, 80, 34, 35, 36; 297/116, 117, 37; 5/52, 28

[56] References Cited

U.S. PATENT DOCUMENTS

| | | | |
|---|---|---|---|
| 132,027 | 10/1872 | Sargent | 108/77 |
| 274,368 | 3/1883 | Peirce | 5/28 |
| 1,709,210 | 4/1929 | Gillespie | 108/77 |
| 2,253,772 | 8/1941 | Edgren | 108/62 |
| 2,295,094 | 9/1942 | Teague | 108/80 |
| 2,528,935 | 11/1950 | Williams | 108/62 |
| 2,607,947 | 8/1952 | Tiffany | 108/80 X |
| 2,837,297 | 9/1974 | Kaplan | 108/69 |
| 3,494,307 | 2/1970 | Kagan | 108/69 |

*Primary Examiner*—Francis K. Zugel

*Attorney, Agent, or Firm*—Reising, Ethington, Barnard, Perry & Brooks

[57] ABSTRACT

A glass top table has pivotally supported end leaves mounted between spaced side frames for movement between an inwardly projecting storage position and an outwardly projecting use position. Each side frame has an upper frame member and a pair of legs projecting downwardly from opposite ends of its upper frame member. A glass table top extends laterally between the upper frame members and is located above the end leaves in their storage position and in alignment therewith in the use position. Each end leaf includes a peripheral rectangular frame which is elongated in a lateral direction and a glass leaf secured to the rectangular frame. A pair of support frame members extend laterally between the upper members of the side frames and are located adjacent the end leaf frames in the storage position thereof so as to provide an aesthetically appealing appearance. Side frame corner blocks connect the upper frame members and legs of the side frames and end leaf corner blocks connect frame members of the end leaf frames. Pins pivotally connect adjacent corner blocks of the side and leaf frames to support each end leaf for movement between its use and storage positions. Pairs of holes in each side frame corner block and associate positioning pins cooperate to locate the end leaves in either their use or storage positions.

12 Claims, 7 Drawing Figures

END LEAF TABLE

BACKGROUND OF THE INVENTION

1. Field of the Invention

The present invention relates to a glass top table having a pair of end leaves pivotally movable between an outwardly projecting use position and an inwardly projecting storage position.

2. Description of the Prior Art

Tables with opaque tops have previously incorporated end leaves that are movable between storage and use positions to minimize the storage space necessary for the table during periods of nonuse while maximizing the usable space of the table when necessary. Usually the leaves of the table extend downwardly in the storage position and such tables are referred to as drop leaf tables. However, as shown by U.S. Pat. Nos. 1,709,210 and 2,295,094, leaves of opaque top tables have also extended inwardly in their storage position toward each other. In supporting such leaves for movement between their inwardly extending storage position and their outwardly extending use position, the opaque nature of the table top permits any type of support desired to be utilized to pivotally mount the leaves for their movement regardless of its appearance.

Glass top tables have also come into relatively widespread use due not only to their aesthetically appealing appearance but also due to their resistance to marking and damage of the table top surface. U.S. Pat. Nos. 3,769,919, 3,974,782 and 3,980,026 disclose various glass top tables having retractable and extendable frames that allow glass table tops of different sizes to be utilized so as to give the table versatility in size. Likewise, U.S. Pat. No. 3,837,297 discloses a glass top table incorporating a retractable and extendable frame for supporting a pair of end leaves that are manually set in place for use and manually removed when a shorter table is required. However, as yet, there has not been any glass top table with pivotal end leaves due to problems in supporting the end leaves for movement between outwardly and inwardly extending positions without having the supports for the leaves observable from above in a manner that would not be aesthetically appealing.

SUMMARY OF THE INVENTION

An object of the present invention is to provide an improved glass top table having a pair of end leaves with respective frames and glass leaves supported by the frames for movement between an inwardly extending storage position below a glass table top and an outwardly projecting use position in alignment with the table top. In carrying out this object, each end leaf frame is pivotally supported by a pivotal connection between a pair of spaced side frames. Upper frame members of the side frames extend longitudinally in a laterally spaced relationship with respect to each other and have opposite ends with a pair of legs projecting downwardly to support the table on the floor. The axis of pivotal end leaf movement extends through the junction between the legs and the upper frame members of the side frames. A pin and hole positioner is utilized to engage the end leaves in either position thereof so as to provide positioning against the downward bias of gravity.

A pair of support frame members extend laterally between the upper side frame members parallel to each other at respective locations spaced from the axes of the end leaf movement. In the end leaf storage position, the frames of the end leaves extend alongside the upper members of the side frames and along the support frame members in an aesthetically appealing manner.

Tubular steel stock is preferably utilized to make the side frames and the end leaf frames with a hard chrome coating being applied thereto as well as to the support frame members so as to enhance the appearance of the table. A corner block connects each leg with the adjacent end of the upper frame member. Likewise, corner blocks connect frame members of the end leaf frames adjacent the corner blocks of the side frames. A pair of pintle pins of each end leaf pivotal connection extend between the adjacent corner blocks of the side and end leaf frames at the corners of the table and provide rugged pivotal connections which are aesthetically appealing as well as being durable in use. Pairs of holes within each side frame corner block receive associated positioning pins to selectively and alternately locate the end leaves in either their use or storage positions.

Each end leaf frame has peripheral frame members defining a laterally elongated rectangular shape and having cooperable supports and retainers that secure the associated glass leaf. The glass leaf supports are of a C-channel shape and are secured to the associated frame members of the end leaves while the retainers are of L-shaped cross sections. One longer leg of the retainer is positioned between the associated frame member and support while a shorter leg thereof engages the periphery of the glass leaf to provide securement thereof to the frame. One end leaf frame member through which the pivotal axis thereof extends has a greater height in cross section than the other end leaf frame members to facilitate positioning of the glass end leaf in the storage position below the glass table top and in the use position flush with the table top.

The objects, features and advantages of the present invention are readily apparent from the following detailed description of the preferred embodiment taken in connection with the accompanying drawings.

DETAILED DESCRIPTION OF THE PREFERRED EMBODIMENT

Figure 1:
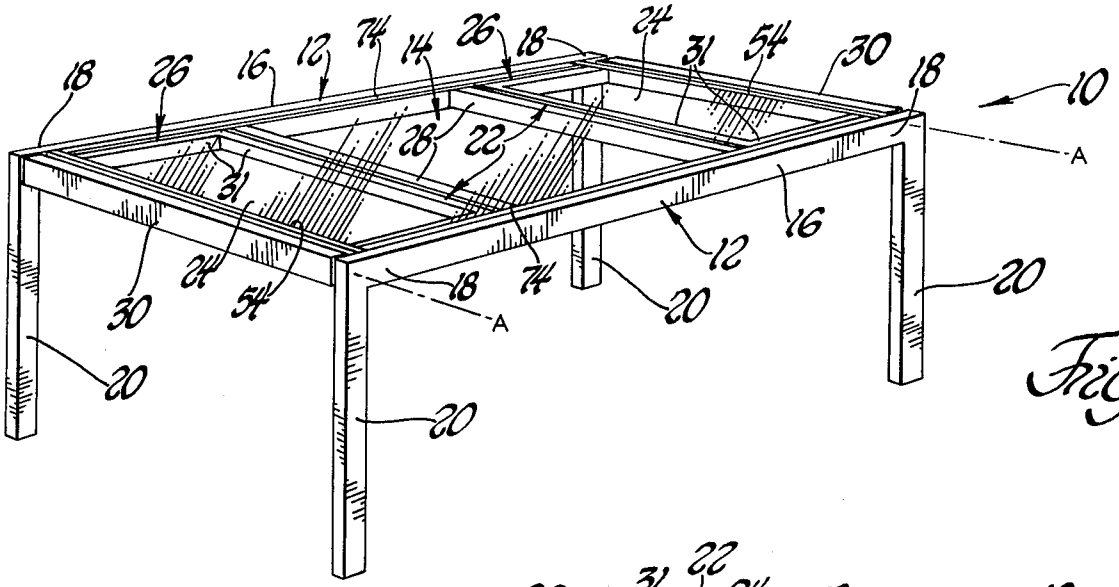
FIG. 1 is a perspective view showing a glass top table of the end leaf type constructed according to the present invention with the leaves thereof located in an inwardly projecting storage position.
Figure 2:
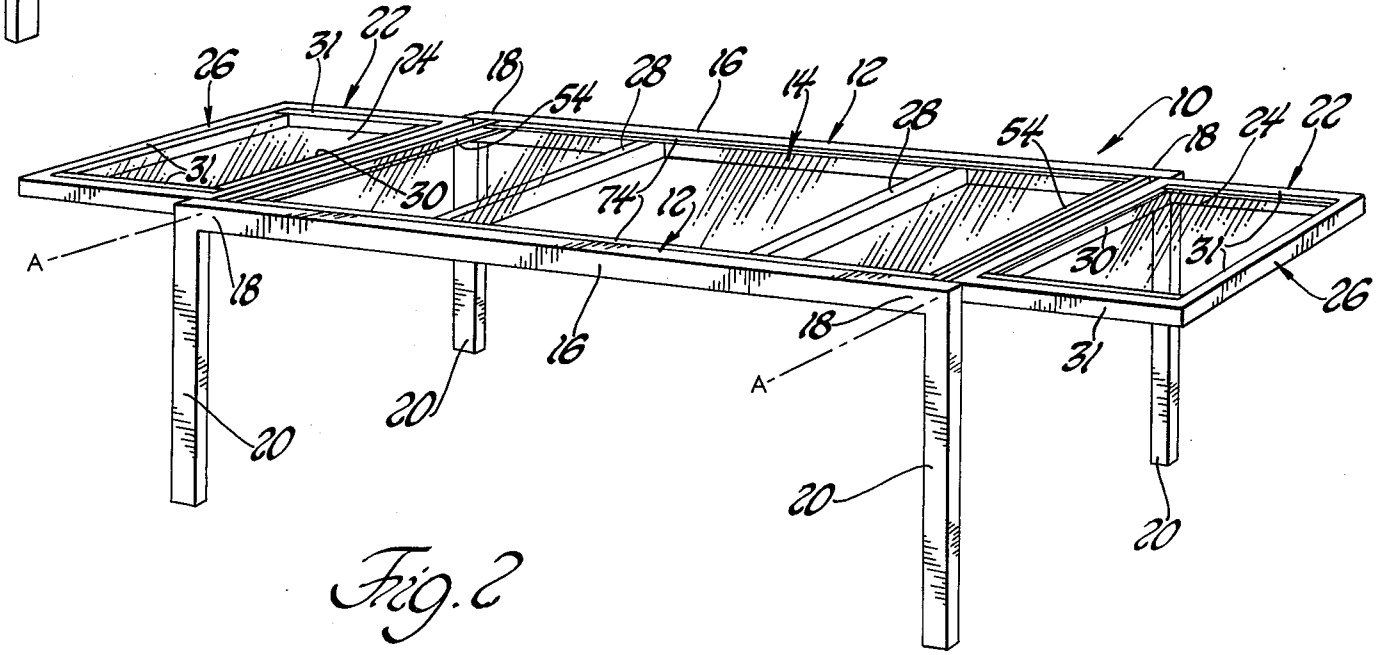
FIG. 2 is a perspective view of the same table shown in FIG. 1 but with the leaves of the table located in an outwardly projecting use position.

Referring to FIGS. 1 and 2, a glass top table of the end leaf type is constructed according to the present invention and indicated generally by reference numeral 10. Laterally spaced side frames 12 of the table support a glass table top 14 through which the floor supporting the table can be viewed from above. Each side frame has an upper frame member 16 extending longitudinally and including opposite ends 18 to which the upper ends of legs 20 are secured. A pair of end leaves 22 of table 10 are pivotally supported between the side frames 12 for movement about associated horizontal axes A between the inwardly projecting storage position shown in FIG. 1 and the outwardly projecting use position shown in FIG. 2. Glass leaves 24 (FIG. 2) of the end leaves 22 have rectangular shapes and are supported by laterally elongated rectangular leaf frames 26 in both the storage and use positions. Pin and hole positioners hereinafter described are utilized to selectively position the end leaves 22 in either of their positions as is hereinafter desired. It will be noted that the table is usable in its shorter position of FIG. 1 due to the manner in which the end leaves 22 project inwardly rather than downwardly when located in the storage position. Likewise, due to the manner in which the end leaves are pivotally supported, as is described later, the table has an aesthetically appealing appearance in this shorter position as well as in the longer position shown by FIG. 2.

A pair of support frame members 28 of the table are best seen in FIG. 2 and extend laterally between the upper side frame members 16 to provide support therebetween as well as providing support for the glass table top 14. Support frame members 28 are oriented parallel to each other in a spaced relationship from the adjacent table end so that the end leaf frames 26 extend alongside the upper frame member ends 18 and along the support frame members in the storage position of FIG. 1 in an aesthetically appealing fashion. Pin and hole positions of the support frames 28, although not shown in the drawings, may be used to aid in holding the end leaves 22 in the storage position projecting inwardly.

Figure 3:
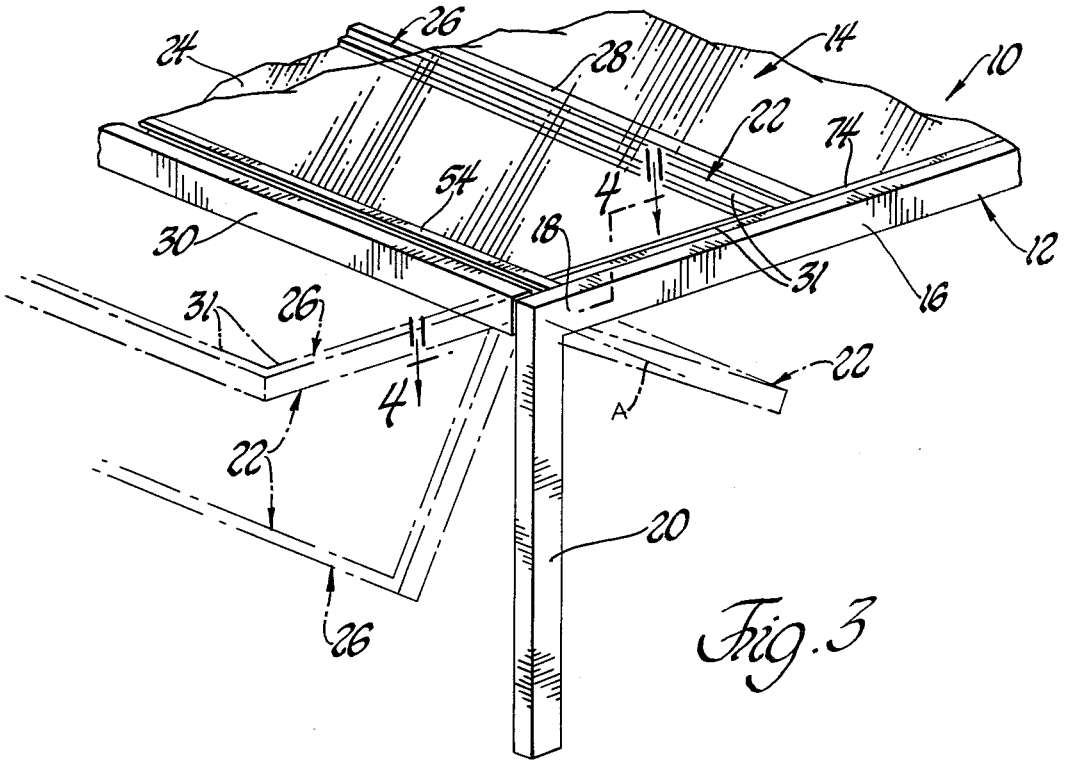
FIG. 3 is an enlarged view of a portion of FIG. 1 and also shows phantom line indicated representation of the table end leaf in its outwardly projecting use position as well as two intermediate positions during movement between the use position and the storage position which is shown by solid line representation.

Each end leaf 22 swings downwardly as shown in FIG. 3 during movement thereof from the storage position projecting inwardly below the table top 14 to the outwardly projecting use position aligned in a flush relationship with the table top. This movement takes place about a pivotal connection of each end leaf 22 to each side frame 12 at each corner of the table.

Figure 4:
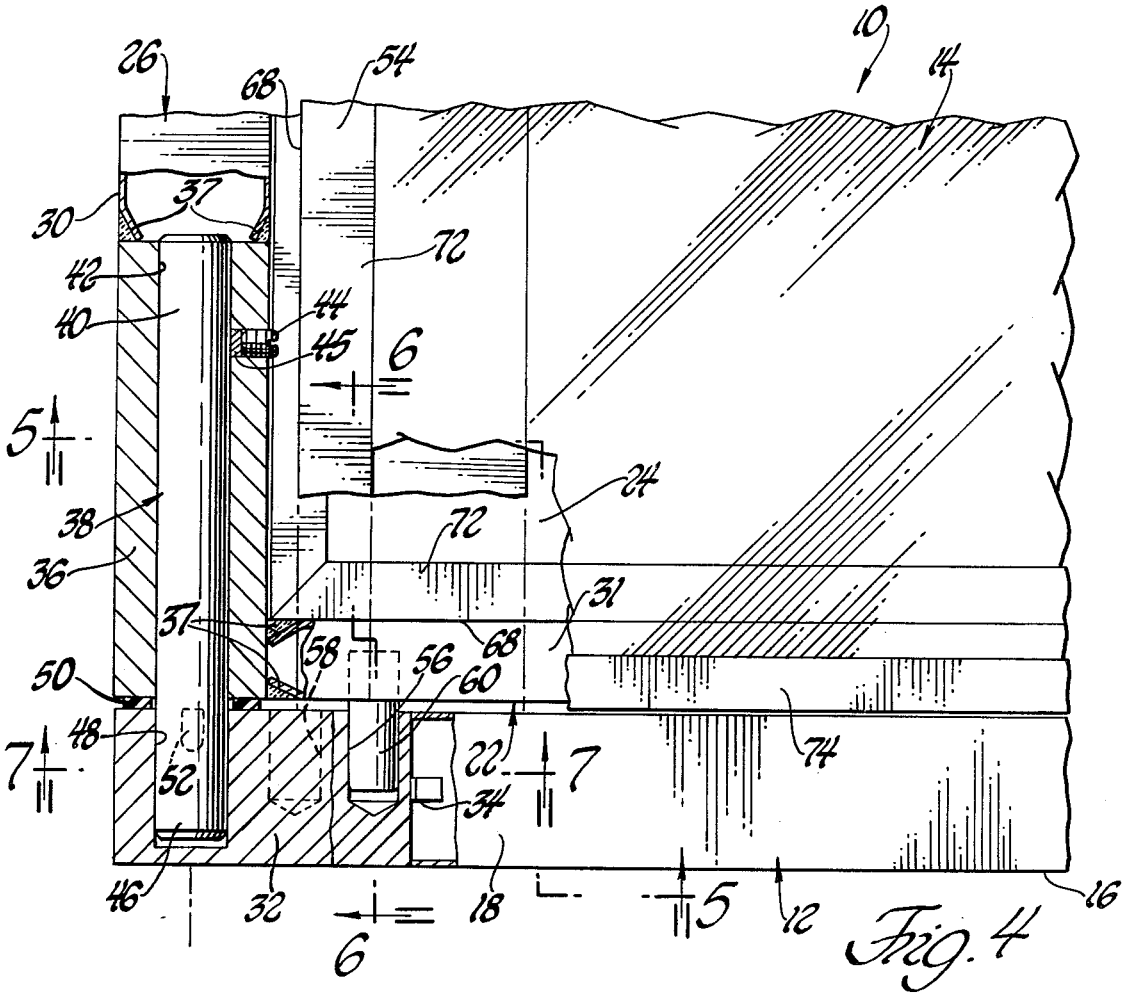
FIG. 4 is a plan view taken partially in section along line 4—4 of FIG. 3 showing the construction of a pivotal connection that supports the end leaf for movement between its storage and use positions.
Figure 5:
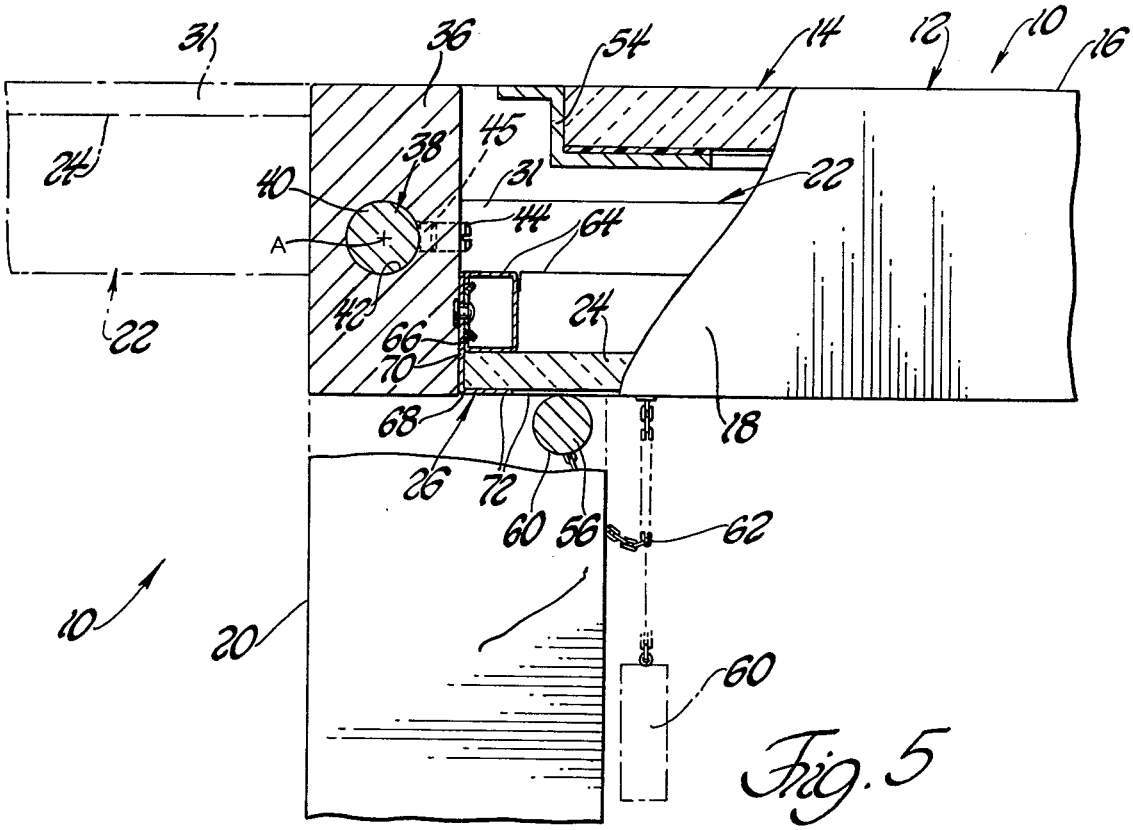
FIG. 5 is an elevation view taken partially in section along line 5—5 of FIG. 4 showing the pivotal connection.
Figure 6:
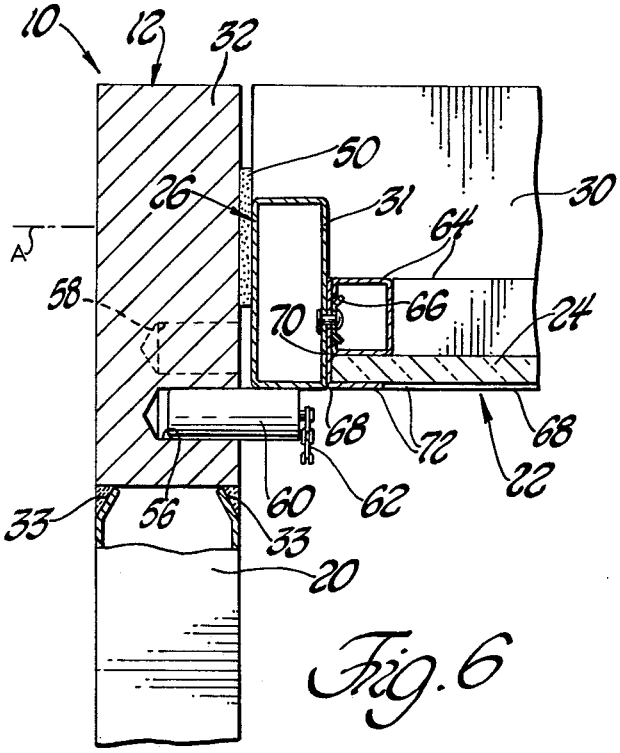
FIG. 6 is an elevation view taken in section along line 6—6 of FIG. 4 showing the manner in which the end leaf is supported in its storage position.

Upper frame members 16 and legs 20 of each side frame 12 as well as frame members 30 and 31 of the end leaf frames 26 are made from tubular steel stock that has a rectangular cross section as best shown in FIGS. 4–6. A hard chrome coating is preferably applied to the table frame members and legs in order to enhance the appearance of the table in conjunction with its glass top construction.

Figure 7:
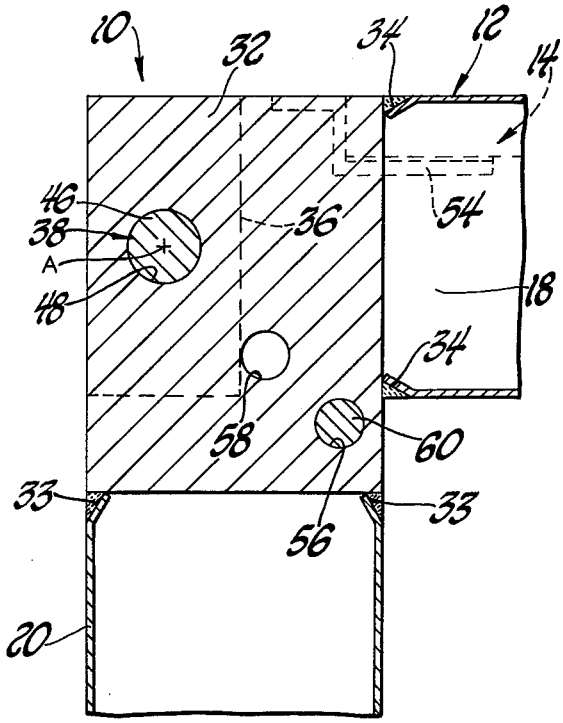
FIG. 7 is an elevation view taken in section along line 7—7 of FIG. 4 showing a frame insert and holes thereof used to position the end leaves in cooperation with an associated positioning pin.

A solid steel corner block 32 located at each table corner is connected to the upper end of each table leg 20 by welds 33 as best seen in FIGS. 6 and 7, and is also connected with the adjacent end 18 of the associated side frame upper member 16 by welds 34. Both welds 33 and 34 are formed by stamping depressions in which the welds are made and then ground flush before covering with the hard chrome plating to provide the table with an appealing appearance.

At each table corner, as illustrated in FIGS. 4 and 5, an end leaf corner block 36 is connected to the frame members 30 and 31 by welds 37 of the same weld construction described above. A laterally extending pintle pin 38 extends between each side frame corner block 32 and the adjacent end leaf frame corner block 36 along the axis A so as to provide the pivotal support for the end leaf on the side frames. Two pintle pins 38 thus cooperate in supporting each end leaf 22 for its movement while located completely between the table side frames 12. One inner end 40 of each pintle pin 38 is received within a round hole 42 in the end leaf frame block 36. Cooperable action of an adjustable set screw 44 and a brass plug 45 that is located between the screw and the inner pin end 40 prevents rapid pivoting of the end leaf on the pin. Another outer end 46 of each pintle pin 38 is received within a drilled and reamed hole 48 in the side frame corner block 32. Between the end leaf 22 and each side frame 12, the pintle pin 38 is encircled by an annular plastic washer 50 that spaces the end leaf from the side frame during pivoting of the end leaf between its use and storage positions. A notch 52 milled in the outer pin end 46 receives a weld that secures the pin to the block 32 in a fixed condition against rotation.

As seen in FIG. 5, the end leaf member 30 along which the pivotal axis A extends has a greater cross sectional height than the other end leaf frame members 31 so that the glass leaf 24 is aligned flush with the table top 14 in the upper use position shown by phantom line representation while still being capable of being positioned in the lower storage position below the table top as shown by solid line representation. Each frame member 31 is located unsymmetrical to axis A and frame member 30 to permit this positioning of the end leaf. The end leaf frame member 30 is located flush with the table top 14 in the storage position (the side of this frame member which faces down in the use position) so as to define the end of the table intermediate the side frames 12. A bent table top support 54 supports each end of the table top 14 extending between the upper side frame member ends 18 in a spaced relationship from the pivotally supported end leaf frame member 30 a sufficient distance so as to permit the end leaf to pivot between its use and storage positions.

As seen in FIG. 7, each side frame corner block 32 has a pair of holes 56 and 58 which are cooperable with a pin 60 to locate the adjacent table end leaf in either its use or storage positions. In the storage position, the pin 60 is inserted within the hole 56 and vertically engages the end leaf frame member 31 projecting along the side frame upper member to prevent downward leaf pivoting from this position. In the use position, the pin 60 is inserted within the hole 58 and engages the pivotally supported end leaf corner block 36 from a horizontal direction so as to prevent downward movement of the end leaf during use. Pin 60 is secured to one end of a chain 62 whose other end is secured on the upper frame member end 18 as shown in FIG. 5 so as to prevent loss of the pin.

As best seen in FIG. 6, each frame member 30 and 31 of the end leaf frame 26 has a C-channel support 64 that is snapped over a number of clips 66 (only one of which is shown) so as to be secured to the associated frame member. A retainer 68 associated with each leaf frame member 30 and 31 has one longer leg 70 positioned between the associated support 64 and the frame member so as to be secured by the clips 66 and also has a shorter leg 72 engaged with the periphery of the glass leaf 24 to secure it in cooperation with the support. In the storage position, the retainer legs 72 prevent downward movement of the glass leaf 24 while this leaf rests on the supports 64 in the use position.

As seen in FIG. 4, while each end of the table top 14 is supported by a bent support 54, each lateral edge of the table top is also supported by an associated support 74. Upper frame members 16 of the side frames 12 have the supports 74 secured to their inner sides in any suitable manner so as to cooperate therewith in supporting the table top.

Also, while it is not shown in the drawings, it should be noted that the laterally extending support frame members 28 are preferably of a channel construction and have a hard chrome coating like the other components of the table.

While a preferred embodiment of the table has herein been described in detail, those familiar with this art will recognize various alternative designs and embodiments for practicing the present invention as defined by the following claims.

What is claimed is:

1. A glass top table comprising: a pair of spaced side frames each of which has a longitudinally extending upper frame member with opposite ends and a pair of legs having upper ends connected to the ends of the upper frame member so as to extend downwardly therefrom; a table top of glass extending laterally between the upper frame members of the side frames and longitudinally between the ends thereof; a pair of end leaves each of which includes a frame and a glass leaf supported thereby; a pivotal connection supporting each end leaf frame on the side frames at adjacent ends of the upper frame members thereof for movement therebetween about a horizontal axis between an inwardly extending lower storage position below the glass table top and an outwardly extending upper use position in alignment with the glass table top; and means for positioning the end leaves in either the storage or use positions.

2. A table as in claim 1 wherein the end leaf frames include peripheral frame members extending about the glass leaves with rectangular shapes and having cooperable supports and retainers on the frame members for securing the glass leaves thereto.

3. A glass top table comprising: a pair of spaced side frames each of which has a longitudinally extending upper frame member with opposite ends and a pair of legs having upper ends connected to the ends of the upper frame member so as to extend downwardly therefrom; a table top of glass extending laterally between the upper frame members of the side frames and longitudinally between the ends thereof; a pair of end leaves each of which includes a frame and a glass leaf supported thereby; a pivotal connection supporting each end leaf frame on the side frames at adjacent ends of the upper frame members thereof for movement therebetween about a horizontal axis between an inwardly extending lower storage position below the glass table top and an outwardly extending upper use position in alignment with the glass table top; means for positioning the end leaves in either the storage or use positions; each side frame having a hollow construction and including a pair of corner blocks respectively connected to the opposite ends of the upper frame member thereof and to the upper ends of the legs thereof; each end leaf frame also having a hollow construction and including a pair of corner blocks respectively located adjacent the corner blocks of the side frames at adjacent ends of the upper frame members thereof; and the pivotal connection supporting each end leaf including a pair of pintle pins extending between the adjacent pairs of corner blocks of the side frames and the end leaf frame supported thereby.

4. A table as in claim 3 wherein the positioning means for the end leaves includes a pair of holes in each side frame adjacent each end leaf, said holes extending into the corner block of the side frame at the adjacent upper frame member end, and a pin that is inserted within one hole or the other hole to engage the end leaf frame and provide positioning thereof in either the use or storage position.

5. A table as in claim 1 further including a pair of laterally extending support frame members extending between the upper side frame members parallel to each other at respective locations to which the end leaves extend in the storage position.

6. A glass top table comprising: a pair of spaced side frames each of which includes a longitudinally extending tubular upper frame member with opposite ends and a pair of tubular legs extending downwardly from the ends of the upper frame member; a pair of support frame members extending laterally parallel to each other between the upper frame members of the side frames at spaced locations from the opposite ends thereof; a table top of glass supported by the upper frame members of the side frames extending between the opposite ends thereof and also supported by the support frame members extending between the side frames; a pair of end leaves each of which includes a laterally elongated rectangular frame and a rectangular glass leaf supported by the frame thereof; a pivotal connection supporting each end leaf frame on the side frames at adjacent ends of the upper frame members thereof for movement therebetween about a horizontal axis between an inwardly extending lower storage position below the glass table top and an outwardly extending upper use position in alignment with the glass table top; the rectangular frame of each end leaf in the storage position extending alongside the upper frame members of the side frames and along the adjacent support frame member; and means for positioning the end leaves in either the storage or use positions.

7. A glass top table comprising: a pair of side frames spaced laterally from each other; each side frame including a tubular steel upper frame member extending longitudinally and having opposite ends; a pair of corner blocks respectively connected to the opposite ends of each upper frame member; each side frame also including a pair of tubular steel legs having upper ends connected to the corner blocks at the opposite ends of the upper frame member thereof so as to extend downwardly therefrom; a pair of support frame members extending laterally parallel to each other between the upper frame members of the side frames at spaced locations from the opposite ends thereof; a table top of glass supported by the upper frame members of the side frames extending between the opposite ends thereof and also supported by the support frame members extending between the side frames; a pair of end leaves each of which includes a laterally elongated rectangular frame and a rectangular glass leaf supported thereby; a pivotal connection supporting each end leaf frame on the side frames at adjacent ends of the upper frame members thereof for movement therebetween about a horizontal axis between an inwardly extending lower storage position below the glass table top and an outwardly extending upper use position in alignment with the glass table top; each pivotal connection including a pair of pintle pins extending between the associated end leaf frame and the corner blocks at the adjacent ends of the upper frame members of the side frames; the rectangular frame of each end leaf being located in the storage position so as to extend alongside the upper frame members of the side frames and to extend along the adjacent support frame member; and means for positioning the end leaves in either the storage or use positions.

8. A table as in claim 7 wherein each end leaf frame includes peripheral frame members extending about the end leaves and also includes supports and retainers that secure the associated glass leaf thereto.

9. A glass top table comprising: a pair of side frames spaced laterally from each other; each side frame including a tubular steel upper frame member extending longitudinally and having opposite ends; a pair of corner blocks respectively connected to the opposite ends of each upper frame member; each side frame also including a pair of tubular steel legs having upper ends connected to the corner blocks at the opposite ends of the upper frame member thereof so as to extend downwardly therefrom; a pair of support frame members extending laterally parallel to each other between the upper frame members of the side frames at spaced locations from the opposite ends thereof; a table top of glass supported by the upper frame members of the side frames extending between the opposite ends thereof and also supported by the support frame members extending between the side frames; a pair of end leaves each of which includes a laterally elongated rectangular frame and a rectangular glass leaf supported thereby; a pivotal connection supporting each end leaf frame on the side frames adjacent ends of the upper frame members thereof for movement therebetween about a horizontal axis between an inwardly extending lower storage position below the glass table top and an outwardly extending upper use position in alignment with the glass table top; each pivotal connection including a pair of pintle pins extending between the associated end leaf frame and the corner blocks at the adjacent ends of the upper frame members of the side frames; the rectangular frame of each end leaf being located in the storage position so as to extend alongside the upper frame members of the side frames and to extend along the adjacent support frame member; and means for positioning the end leaves in either the storage or use positions, and the positioning means including a pair of holes in each corner block and a pin associated with each pair of holes so as to be inserted within one hole or the other hole to engage the adjacent end leaf frame and provide positioning thereof in either the use or storage position.

10. A table as in claim 7 wherein the side frames, the support frame members, and the end leaf frames each have a hard chrome coating.

11. A table as in claim 7 wherein each end leaf frame includes a first frame member through which the axis of pivotal connection thereof to the side frames extends and three other frame members of a shorter cross sectional height than the first frame member.

12. A glass top table comprising: a pair of spaced side frames each of which has a longitudinally extending upper frame member with opposite ends and a pair of legs having upper ends connected to the ends of the upper frame member so as to extend downwardly therefrom; a table top of glass extending laterally between the upper frame members of the side frames and longitudinally between the ends thereof; a pair of end leaves each of which includes a frame and a glass leaf supported thereby; a pivotal connection supporting each end leaf frame on the side frames at adjacent ends of the upper frame members thereof for movement therebetween about a horizontal axis between an inwardly extending lower storage position below the glass table top and an outwardly extending upper use position in alignment with the glass table top; each end leaf frame including a member that is aligned with the table top in a coplanar relationship in both the use and storage positions; the table top of glass being located in spaced relationship to said member of each end leaf frame to allow pivotal movement thereof between the use and storage positions; and means for positioning the end leaves in either the storage or use positions.

* * * * *